United States Patent [19]

Brown

[11] Patent Number: 4,576,229

[45] Date of Patent: Mar. 18, 1986

[54] DEVICE FOR FACILITATING RELEASE OF STUCK DRILL COLLARS

[75] Inventor: Robert L. Brown, Buena Park, Calif.

[73] Assignee: DMI Wireline, Inc., Broussard, La.

[21] Appl. No.: 632,811

[22] Filed: Jul. 20, 1984

[51] Int. Cl.[4] ..... E21B 31/00

[52] U.S. Cl. ..... 166/177; 166/301; 175/298; 175/301; 175/321

[58] Field of Search ..... 166/55, 99, 177, 178, 166/301; 175/298, 301, 306, 320, 321

[56] References Cited

U.S. PATENT DOCUMENTS 3,132,707 5/1964 Alexander ..... 175/298

4,196,781 4/1980 Cheek ..... 175/321 X

*Primary Examiner*—Stuart S. Levy

*Assistant Examiner*—David Werner

*Attorney, Agent, or Firm*—Klein & Szekeres

[57] ABSTRACT

A device is disclosed which is to be incorporated into a drill string used for drilling in subterranean formations. The device includes a first member concentrically mounted with drill pipes disposed above the device and a second member concentrically mounted with drill collars or drill pipes disposed below the device. An intermediate member connects the first and second members and a retainer member maintains the device in its first operative position wherein the entire device is concentric with the longitudinal axis of the drill string. In the first operative position of the device rotation can be transmitted from the first member to the second member and the device acts as an ordinary member of the drill string. The first, second and intermediate members are configured to be capable of occupying a second operative position relative to one another wherein the first member is off-center relative to the second member and wherein the first member does not rotate the second member. The device is shifted into the second operative position by an axial force exceeding a predetermined level, which force breaks the retainer member or renders it incapable of holding the device in the first operative position. Rotation of the drill string from the surface causes a camming action and vibration in the second operative position of the device which helps to free stuck portions of the drill string.

22 Claims, 12 Drawing Figures

DEVICE FOR FACILITATING RELEASE OF STUCK DRILL COLLARS

BACKGROUND OF THE INVENTION

1. Field of the Invention

The present invention is directed to equipment for drilling in subterranean formations. More particularly, the present invention is directed to a device which is incorporated in the drill string and which facilitates release of stuck portions of the drill string.

2. Brief Description of the Prior Art

Equipment used for lowering a drill bit into subterranean formations usually includes a string of drill pipes and a bottom hole assembly containing a plurality of drill collars. The drill collars are pipes which have larger diameter, thicker wall and therefore heavier weight than the drill pipes of the upper portions of the drill string. The drill collars are usually necessary for providing sufficient weight for the operation of the drill bit which is at the bottom of the assembly.

The drill string is rotated from the surface by a rotary table. In conventional drilling operations, the rotary table rotates the drill string and provides the power for driving the drill bit into the formation. In other drilling operations, the power to drive the drill bit is derived from a downhole motor.

The downhole motor is usually driven by the pressure of drilling mud which is continuously pumped downhole in the interior of the drill string and which rises to the surface between the walls of the bore hole and the exterior walls of the drill string.

As is well known, portions of the drill string, particularly the lower portions, occasionally become strongly attached, "differentially stuck", to walls of the bore hole. The reason for this is that the external diameter of the drill collars is relatively close to the diameter of the bore hole, and that the drilling mud is circulated in the bore hole under high pressure. This pressure often exceeds several thousands of pounds per square inch (psi). When for some reason, pressurized drilling mud is excluded from between the wall of the drill collar and the subterranean formation then the hydrostatic pressure prevailing in the hole presses the drill collar against the formation with tremendous force. Most frequently such "differential sticking" of a portion of the drill collar to the formation occurs because of accumulation of mud or debris between the drill collar and the formation.

Regardless of the original reason for sticking of the drill collar (or drill pipes) in the bore hole, the phenomenon represents a serious and expensive-to-solve problem for the drilling industry. As is well known, when the drill collar is stuck, the actual drilling operation halts. In accordance with usual practice in the art, the workmen at the drilling rig first try to free the stuck drill collars. When the attempts to free the stuck drill collars fail, then the stuck portion is usually severed from the portion of the drill string which is located above it. The stuck portion of the drill string is either abandoned in the bore hole or is retrieved ("fished-out") from the hole by using various retrieval techniques and devices.

Unfortunately from the view point of the drilling industry, accumulation of solid mud or debris between the walls of a drill collar and the formation is usually accelerated whenever rotation or movement of the drill collars is halted. Thus, unless a differentially stuck drill collar is freed promptly, larger and larger portions become hydrostatically pressed against the formation and freeing the assembly becomes progressively more difficult.

Even though the prior art has been well aware of the abovesummarized problem, it has been, by-and-large, unable to provide an effective solution. Severing the free portion of the drill string from the stuck portion and thereafter abandoning the stuck portion (free point and back-off) is not considered an effective solution in this regard. Other attempts to solve the problem include devices which are located at the top of the drill collars and provide repeated, large, axially directed jolts to the drill string. Many times, however, these devices are unable to free the stuck drill string. For these reasons the present invention fills a great need in the prior art.

SUMMARY OF THE INVENTION

It is an object of the present invention to provide a device for freeing stuck portions of a drill string, and particularly to provide a device for freeing differentially stuck drill collars.

It is another object of the present invention to provide a device for freeing stuck portions of a drill string, which device can be incorporated into practically all drill strings, and which is actuable for operation whenever the need arises.

The foregoing and other objects and advantages are attained by a device which is mountable intermediately in the drill string, substantially concentrically with the longitudinal axis of the drill string. The device is usually mounted above the drill collars and just below the drill pipes of the drill string. The device includes a first member concentrically mounted with the drill pipes and a second member concentrically mounted with the drill collars. An intermediate member connects the first and second members in a first, "normal" position wherein these members are in a concentric relationship relative to one another. In the dirst position of the first, second and intermediate members rotation of the drill pipe can be transmitted to the drill collars through these members.

The first, second and intermediate members are held together in their first position by a retainer member which is either severed by application of an axially directed pulling force exceeding a predetermined magnitude, or which, after application of the axially directed pulling force no longer holds the first, second and intermediate members in their first, substantially concentric relationship.

The first, second and intermediate members are configured in such a manner that after application of the axially directed pulling force exceeding the predetermined magnitude, the members are disposed in a second, off-center position relative to one another. The first member is mounted to the intermediate member so that both are capable of free rotation relative to the second member.

During normal drilling operations the device of the present invention is not activated. It merely transmits torque from the drill pipes to the drill collars as an ordinary member of the drill string. When the drill collars become stuck, however, the drilling operator at the drilling rig applies the predetermined pulling force to the drill string thereby causing the first member of the device to occupy its off-center position relative to the second member. This enables the first and intermediate members to rotate freely relative to the second member and the stuck drill collars. As the drill pipes are rotated from the surface by the rotary table the eccentrically disposed first member causes a camming, prying action and a vibration which facilitates freeing of the stuck portions of the drill collars.

The features of the present invention can be best understood together with further objects and advantages, by reference to the following description, taken in connection with the accompanying drawings wherein like numerals indicate like parts.

DETAILED DESCRIPTION OF THE PREFERRED EMBODIMENTS

The following specification taken in conjunction with the drawings sets forth the preferred embodiments of the present invention. The embodiments of the invention disclosed herein are the best modes contemplated by the inventor for carrying out his invention in a commercial environment, although it should be understood that various modifications can be accomplished within the parameters of the present invention.

Figure 1:
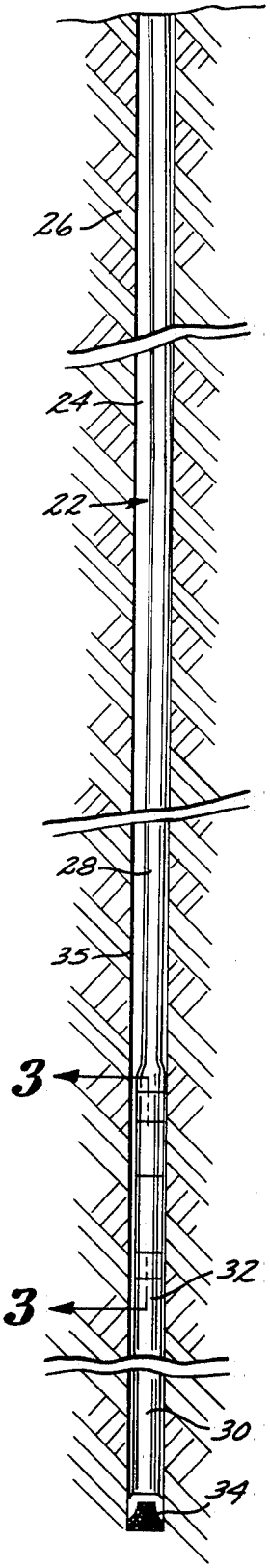
FIG. 1 is a schematic view of the device of the present invention mounted to a drill string in a bore hole, the view showing the device during normal drilling operation.
Figure 2:
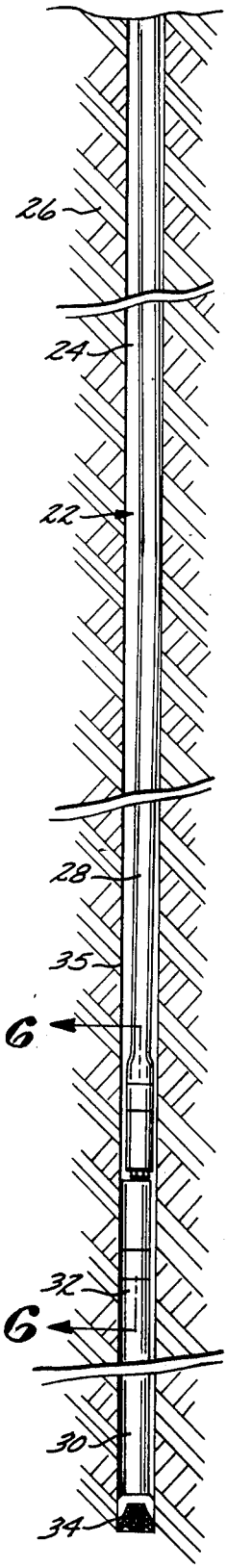
FIG. 2 is a schematic view of the device of the present invention mounted to a drill string in a bore hole, the view showing the device in its position for freeing a stuck portion of the drill string which is disposed below the device.
Figure 3:
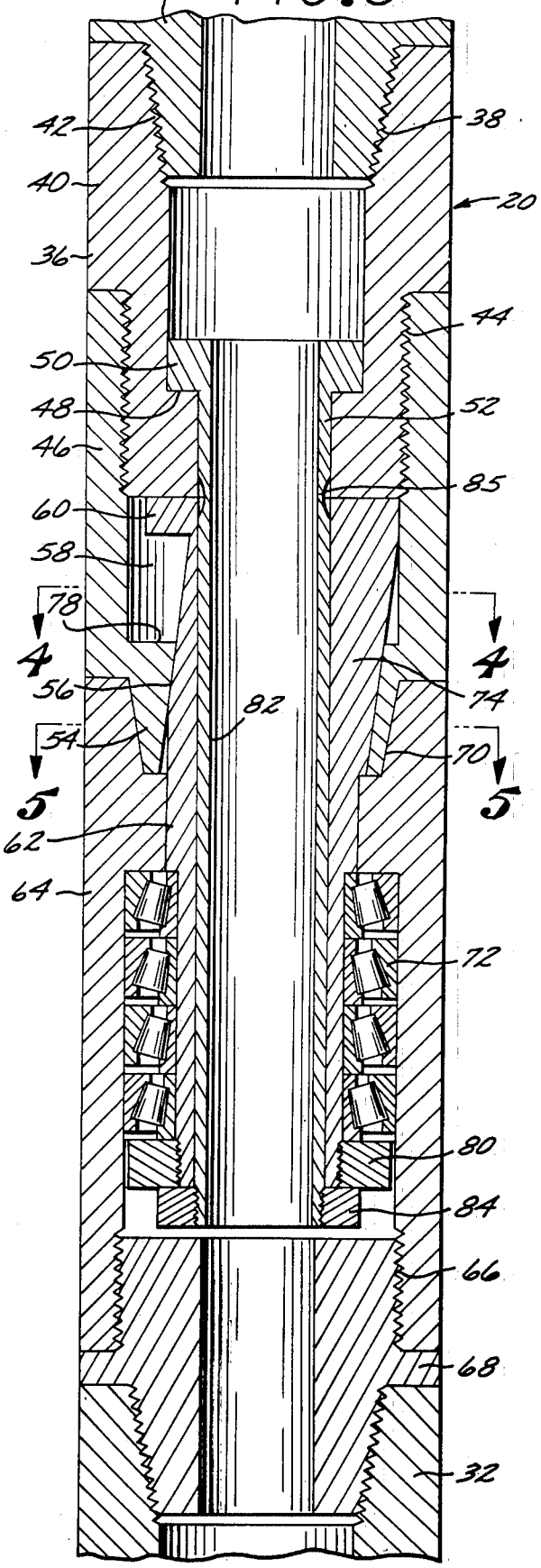
FIG. 3 is a cross-sectional view of the device in its first position adapted for normal drilling operations, the view being taken on lines 3,3 of FIG. 1.

Referring now to the drawing Figures, and particularly to the cross-sectional view of FIG. 3, a first preferred embodiment 20 of the stuck drill collar freeing or releasing device of the present invention is disclosed. As is shown on FIGS. 1 and 2, the device of the present invention is incorporated in the drill string 22 which is disposed in a nominally vertical bore hole 24 drilled in a subterranean formation 26. The drill string 22 includes a plurality of drill pipes 28 attached to one another in the manner customary in the drilling industry. and a bottom hole assembly 30 which is disposed below the drill pipes 28. The bottom hole assembly 30 includes a plurality of drill collars 32 and a drilling bit 34 disposed at the bottom of the drill string 22. In addition to the above-noted major components, the drill string 22, and particuarly the bottom hole assembly 30 thereof may also include additional components such as various subs (not shown) downhole drilling motors (not shown), mule shoes (not shown) and equipment (not shown) for sensing or recording the direction of the bore hole 24.

As it was noted above in the introductory section of the present application for patent, the drill string 22 is normally rotated by a rotary table (not shown) which is located on the drilling rig (not shown) on the surface. In certain type of drilling operations the power for drilling in the formation is provided by the rotary table (not shown). In some other type of drilling operations the power for drilling is provided by a downhole motor (not shown) driven by drilling mud (not shown) which is continuously pumped downwardly within the hollow interior of the drill string 22, and which flows upwardly between the exterior of the drill string 22 and the walls 35 of the bore hole 24. The rotary table (not shown) however, occasionally rotates the drill string slowly even when a downhole motor is used. This is done to avoid, to the maximum extent possible, differential sticking of any portion of the drill string 22 to the walls 35 of the bore hole 24. The device of the present invention is suitable for freeing stuck sections of the drill string 22 regardless whichever technique is used to power the drilling operation.

As it was further noted in the introductory section of the present application for patent, the drill collar containing bottom hole assembly 30 is the portion of the drill string 22 which is most likely to become differentially stuck. Therefore, the device of the present invention is primarily adapted to be mounted in the drill string 22 above the bottom hole assembly 30 just above the uppermost drill collar 32 and below the lower most drill pipe 28. Such mounting of the device of the present invention is shown in the drawing Figures. It should be kept in mind, however, that the present invention is not so limited in principle, and the device of the present invention can be intermediately mounted in the drill string 22 substantially anywhere.

In accordance with the present invention, the device of the present invention is capable of conducting the flow of drilling mud (not shown) in its interior. In normal operation the device of the present invention acts as a substantially regular, concentrically mounted and disposed member of the drill string 22. The device of the present invention is adapted to be actuable to free stuck portions of the drill string 22, particularly the bottom hole assembly 30, only when the need arises.

Referring now primarily to the cross-sectional view of FIG. 3, the device of the present invention is shown to include a first member 36 which is attached to the lowermost drill pipe 28 by threaded joints conventionally used for joining pieces of downhole drilling equipment. More specifically, the drill pipe 28 includes a male thread 38, and the first member 36 comprises two pieces. A top piece 40 of the first member 36 has a female thread 42 through which the top piece 40 is mounted to the male thread 38 of the drill pipe 28. The top piece 40 also has a male thread 44 on the lower part thereof. A second or lower piece 46 of the first member 36 is threadedly attached to the male thread 44 of the top piece 40. The top piece 40 is hollow to permit circulation of drilling mud (not shown). The hollow interior of the top piece 40 includes a shoulder 48 in which a rim 50 of a retainer member 52 rests. The retainer member 52 is described in more detail below.

The second piece 46 of the first member 36 has a tapered male hexagonal boss 54 at its bottom and an interior hexagonal bore 56 which is at an angle relative to the longitudinal axis of the first member 36 and of the drill string 22. In the herein described first specific embodiment 20 of the device of the present invention, the interior hexagonal bore 56 of the second piece 46 of the first member 36 is machined at an angle of 0.125 inch per longitudinal inch. The second piece 46 of the first member 36 contains, above the interior hexagonal bore 56, a socket or cavity 58 to receive and accomodate an upper retainer collar 60 of an intermediate member or spindle 62 which is described in more detail below.

A second member 64 of the device of the present invention has a female thread 66 at its lowermost portion so it can be fastened to an appropriate cross-over 68. The cross-over 68 is, in turn, threadedly fastened to the uppermost drill collar 32 of the bottom hole assembly 30. The second member 64 incorporates a hexagonal opening or cavity 70 which matches and receives the hexagonal boss 54 of the second piece 46 of the first member 36. The second member 64, like the first member 36, is also hollow to permit circulation of drilling mud (not shown) and to accomodate cables (not shown) and the like which may be utilized for placing electronic sensors (not shown), cameras (not shown) and other equipment (not shown) into the bottom hole assembly 30.

Figure 8:
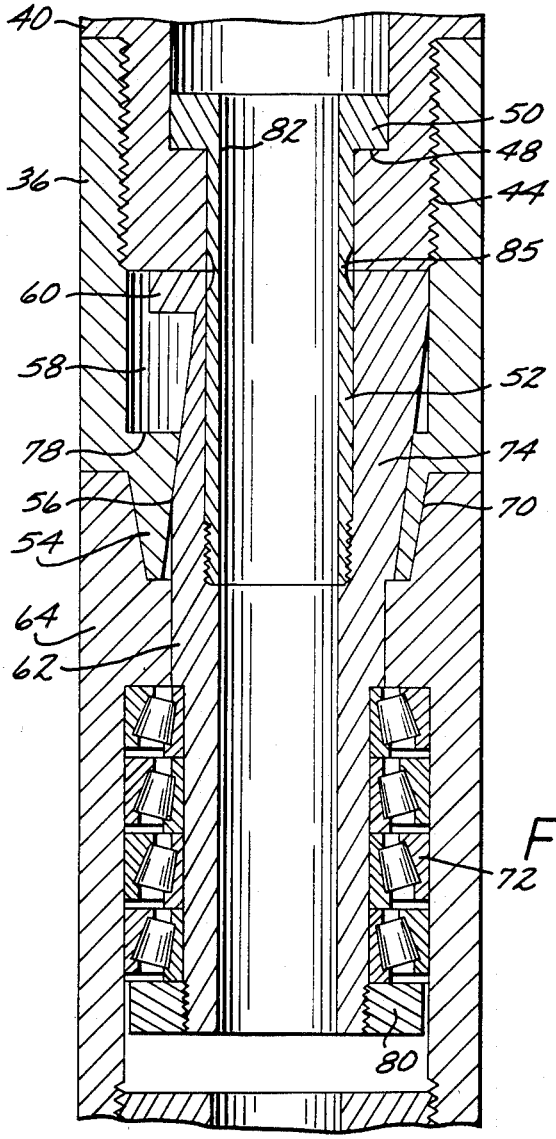
FIG. 8 is a partial cross-sectional view of a second preferred embodiment of the device of the present invention, the view being analogous to the cross-sectional view shown in FIG. 3.

The second member 64 includes a plurality of bearings 72 which, under certain conditions, permit free rotation of the intermediate member or spindle 62 relative to the second member 64. Preferably, the bearings 72 comprise four (4) Timken tapered roller bearings, shown in FIGS. 3, 6 and 8. In accordance with the present invention, the first member 36 always rotates together with the drill pipes 28 to which the first member 36 is attached, and the second member 64 always rotates together with the drill collars 32 to which the second member 64 is attached.

Figure 4:
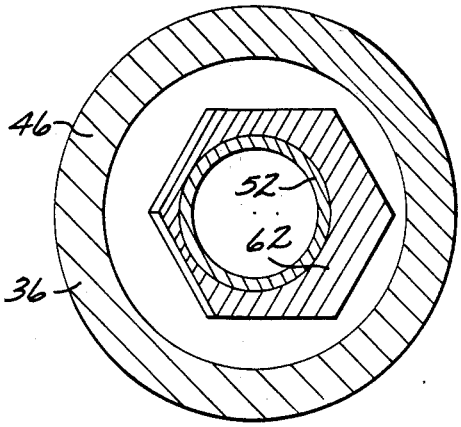
FIG. 4 is a cross-sectional view of the device of the present invention, the cross-section being taken on lines 4,4 of FIG. 3.
Figure 5:
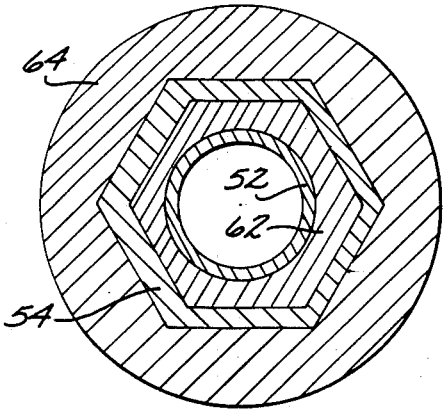
FIG. 5 is a cross-sectional view of the device of the present invention, the cross-section being taken on lines 5,5 of FIG. 3.

The intermediate member or spindle 62 includes a hexagonal section 74 which matches and is accomodated in the hexagonal bore 56 of the second piece 46 of the first member 36. The hexagonal section 74, well shown on the cross-sectional view of FIG. 4, is machined at the same angle to the longitudinal axis of the device of the present invention as the hexagonal bore 56, so that the spindle 62 is capable of limited sliding motion in the hexagonal bore 56.

A collar or rim 60 is provided in the upper portion of the spindle 62. The collar 60 is disposed in the socket or cavity 58 of the second piece 46 of the first member 36. The collar 60 limits the sliding motion of the spindle 62 in the hexagonal bore 56 by engaging a corresponding shoulder 78 in the bottom of the socket 58. A threaded retainer ring 80 engages the bottom of the spindle 62 just below the bearings 72. As is shown in the drawing Figures, and particularly FIGS. 3 and 6, the spindle or intermediate member 62 is disposed within the interiors of the first member 36 and the second member 64.

The retainer member 52 is a hollow tubular body which is disposed within the interior of the spindle 62. Consequently, inner walls 82 of the retainer member 52 comprise a conduit for the drilling mud (not shown). The function of the retainer member 52 is to normally hold the first member 36, the second member 64 and the intermediate member or spindle 62 together as is shown on FIG. 3. For this purpose the rim or collar 50 of the retainer member 52 is engaged by the shoulder 48 formed in the top piece 40 of the first member 36, and the bottom of the retainer member is engaged by a second threaded ring 84. The second threaded ring 84 is disposed below the first threaded ring 80, as is shown in FIG. 3. In the alternative preferred embodiment of the device of the present invention shown on FIG. 8, the retainer member 52 is threadedly engaged in the spindle 62, and therefore the second retainer ring 84 is not needed.

As an important feature of the present invention the retainer member 52 is designed to retain the first member 36, the second member 64 and the intermediate member 62 in their first relative positioning only until an axial force exceeding a predetermined magnitude is applied to the device of the present invention. Therefore, the retainer member 52 includes a weak, thin walled section 85 which is designed to break when the axial force exceeding the predetermined magnitude is applied. The breaking strength of the weak, thin walled section 85 is approximatey two to three times the weight of the bottom hole assembly 30. When the drill collars are of eight (8) inch diameter and the bottom hole assembly 30 is of conventional length, the breaking strength of the thin walled section 85 is typically and approximately 75,000 lbs.

Operation of the device of the present invention should be readily apparent to those skilled in the art from the foregoing description taken in conjunction with the drawing Figures. When the retainer member 52 is intact, as is shown on FIG. 3, the hexagonal boss 54 of the second piece 46 of the first member 36 engages the corresponding hexagonal cavity 70 of the second member 64. The intermediate member or spindle 62 is disposed in the position shown on FIG. 3, and the spindle 62 and the second member 64 are both rotated by the first member 36. The first member 36, the second member 64 and the spindle 62 are disposed concentrically with one another and with the general longitudinal axis of the drill string 22. In this first operative position of the device of the present invention, the device is "transparent" from the viewpoint of the drilling operator (not shown) in the sense that it does not interfere with normal drilling operations.

Figure 7:
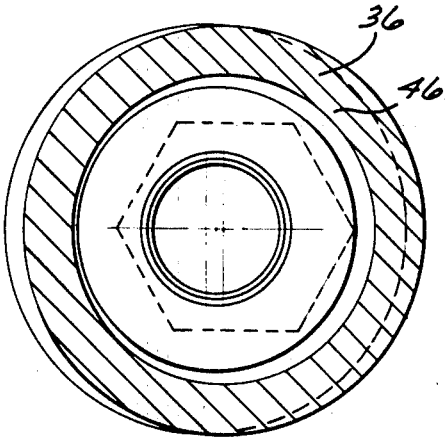
FIG. 7 is a cross-sectional view of the device of the present invention, the view taken on lines 7,7 of FIG. 6.
Figure 6:
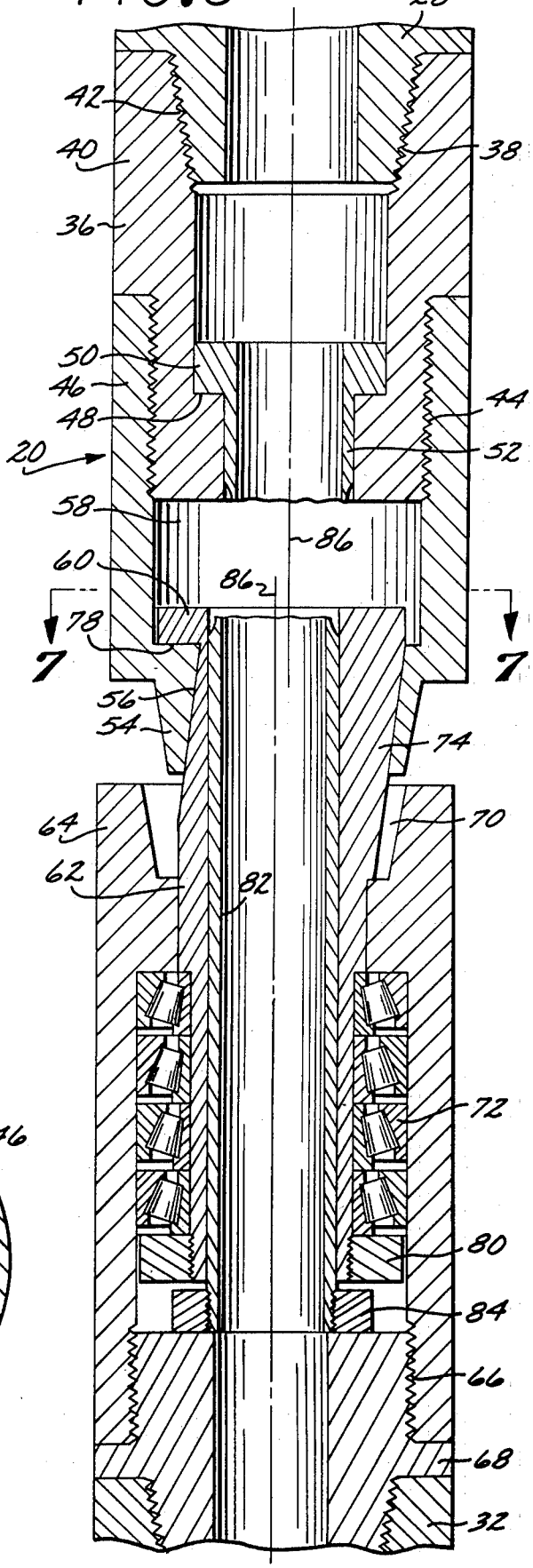
FIG. 6 is a cross-sectional view of the device in its second position adapted for freeing a stuck portion of the drill string disposed in the bore hole below the device, the view being taken on lines 6,6 of FIG. 2.

FIGS. 2, 6 and 7 show the device of the present invention in a second operative position after the device was actuated by the driling operator (not shown) to free the stuck bottom hole assembly 30. To accomplish this, the drilling operator (not shown) lifts the drill string 22 at the drilling rig (not shown) with blocks (not shown) or the like until the predetermined breaking force of the weak section 85 of the retainer member 52 is exceeded. It should be readily understood by those skilled in the art, that unless a portion of the drill string 22 disposed below the device of the present invention is stuck, the breaking force necessary to rupture the weak section 85 of the retainer member 52 can not be attained by lifting the drill string 22. This, of course, serves as a safe guard during normal drilling operations.

Once the retainer member 52 is ruptured, the first member 36 and the drill string disposed above the first member 36 are shifted upwardly relative to the intermediate member of spindle 62 and relative to the second member 64 and the stuck bottom hole assembly 30. During this movement the hexagonal section 74 of the spindle 62 slides in the hexagonal bore 56 until the collar 60 of the spindle 62 interferes with the bottom of the socket 58, as is shown on FIG. 6.

Because the hexagonal bore 56 is at an angle relative to the longitudinal axis of the device of the present invention, in this second operative position of the device of the present invention the first member 36 is off-center relative to the second member 64 and relative to the stuck bottom hole assembly 30. This is shown on FIG. 6 where the longitudinal center line or axis of the device of the present invention is shown with a dotted line and bears the reference numeral 86. In the second operative position of the device of the present invention, the hexagonal boss 54 of the first member 36 is disengaged from the matching hexagonal cavity 70 of the second member 64. Therefore, the second member 64 is no longer rotated by the first member 36. Instead, the bearings 72 permit free rotation of the spindle 62 in the stationary second member 64.

Figure 12:
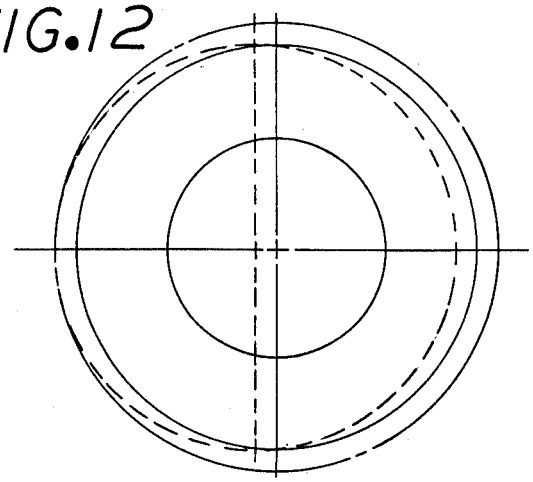
FIG. 12 is a schematic view showing the geometry of the device of the present invention when it is used to free a stuck portion of the drill string.

In accordance with the present invention, in an effort to free the stuck bottom hole assembly 30, the drilling operator (not shown) slowly rotates the drill string with the rotary table (not shown) in the second operative position of the device. The schematic view of FIG. 12 illustrates the effect of this rotation. Because the rotating first member 36 is off-center relative to the stuck portion, during each revolution the first member 36 is likely to come into contact with the formation 26 to provide a jolt substantially at a right angle to the nominal longitudinal axis of the drill string 22. This is a camming or prying action which has not been accomplished in any known working device of the prior art.

In addition to the horizontal impulse and camming action, the off-center positioning of the rotating mass also causes a vertical impulse in the stuck drill string. These effects are likely to cause vibration and resonance in the stuck portion in the horizontal direction or in the vertical direction, or both, which help to free the stuck portion. In order to attain optimal frequency of vibration for freeing the stuck portion, (horizontal or vertical resonance) the drilling operator (not shown) may gradually adjust the speed of rotation of the rotary table (not shown).

Once the stuck portion is freed, the entire drill string 22 may be removed from the bore hole 24. Alternatively, the upper portion of the drill string may be slowly lowered while the rotary table (not shown) is carefully rotated, to re-seat the hexagonal boss 54 in the matching cavity 70 of the second member 64. Then, the drilling operation may continue because the device of the present invention is again "transparent" for the purposes of ordinary drilling.

Several modifications of the device of the present invention are apparent from the foregoing description. For example, instead of hexagonal bosses, bores and matching cavities, other multifaceted bosses, bores and cavities may be used. Alternatively, bosses, bores and cavities of cylindrical cross-section having appropriate splines and spline receiving slots, respectively, may be incorporated in the device of the preesnt invention.

Figure 9:
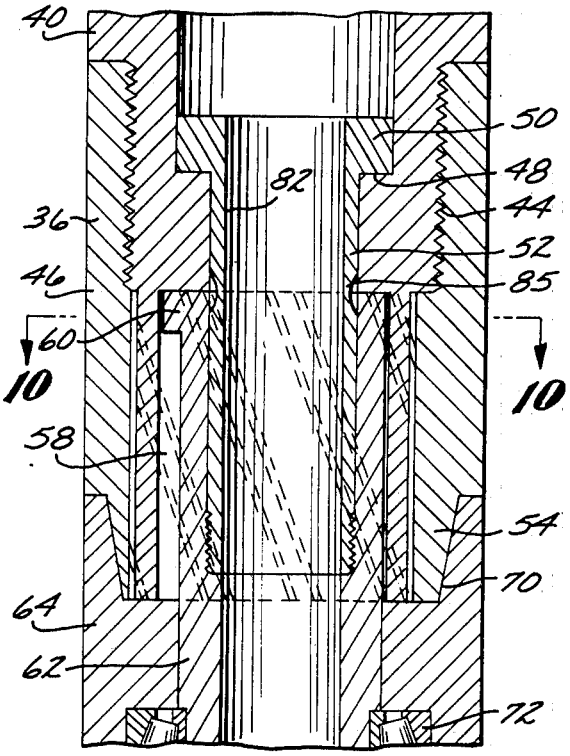
FIG. 9 is a partial cross-sectional view of a third preferred embodiment of the device of the present invention.
Figure 10:
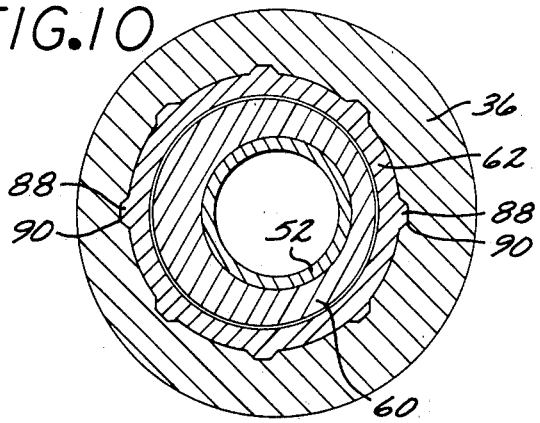
FIG. 10 is another cross-sectional view of the third preferred embodiment of the device of the present invention, the cross-section being taken on lines 10,10 of FIG. 9.

FIGS. 9 and 10 illustrate a third preferred embodiment of the device of the present invention. In this embodiment the offcenter positioning of the first member 36 in the second operative position is accomplished by providing spiral splines 88 in the spindle 62 and matching spiral spline receiving slots 90 in the spindle receiving cavity 70 of the first member 36. The splines 88 and the spline receiving slots 90 are off-set relative to the longitudinal axis of the device, so that unless the spindle 62 is fully inserted into the cavity 70 , as shown in FIG. 9, the first member 36 and the second member 64 are off-center relative to one another.

Figure 11:
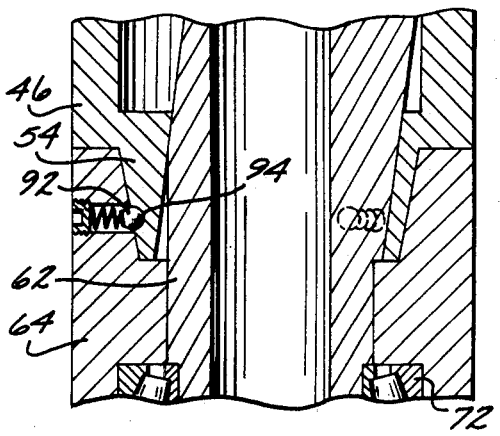
FIG. 11 is a partial cross-sectional view of a fourth preferred embodiment of the device of the present invention.

FIG. 11 illustrates a fourth preferred embodiment wherein the first member 36 is maintained in the second member 64 by a spring biased ball 92 which is held in a suitable ball seat 94. In this embodiment, there is no retainer member 52. Application of the predetermined, or larger, axial force unseats the ball 92 from the ball seat 94 and permits the device to shift into its second operative position.

Generally speaking, the device of the present invention is manufactured from steels of the type which are normally used for construction of downhole drilling equipment. The device of the present invention is typically and approximatey four (4) feet long and weighs approximately 600 lbs. The device of the present invention can, of course, be manufactured to fit eight (8) inch diameter or other drill collars and various size drill pipes. The device of the present invention is advantageously incorporated in every drill string whenever the possibility for differential sticking exists.

The breaking strength of the weak walled section 85 of the retainer member 52, or the spring bias of the alternative embodiment shown in FIG. 10 may be specifically adjusted for each drilling operation to fit the anticipated drilling conditions and the weight of the bottom hole assembly. When the weak walled retainer member 52 of the first preferred embodiment 20 is used, it is advantageous to manufacture the retainer member 52 from a lower strength steel than the rest of the device. This renders the dimensions of the weak walled section 85 somewhat less critical and therefore simplifies machining of the weak walled section 85.

Several additional modifications of the device of the present invention may become readily apparent to those skilled in the art in light of the foregoing disclosure. Therefore, the scope of the present invention should be interpreted solely from the following claims.

What is claimed is:

1. A device adapted to be incorporated into a drill string used in subterranean drilling, for normally functioning as a rigid element capable of transmitting torsional force from a portion of the drill string which is disposed above the device to the portion of the drill string which is disposed below the device, and for facilitating release of stuck portion of the drill string, the device comprising:

first means for fixedly but removably mounting the device intermediately into the drill string to normally occupy a first operative position therein, the entire device being substantially concentric with the longitudinal axis of the drill string in said first operative position;

second means incorporated into the device for placing the device into a second operative position when a greater than predetermined substantially axial force is applied to the device, in the second operative position the portion of the drill string disposed above the device being off-center relative to the portion of the drill string disposed below the device, and third means incorporated in the device to permit, in the second operative position, free rotation of the portion of the drill string disposed above the device relative to the portion of the drill string disposed below the device, whereby rotation of the portion above the device causes a camming action against walls of the bore hole and a vibration, said camming action and vibration facilitating release of stuck portion of the drill string below the device.

2. The device of claim 1 wherein the first means comprise screw threads for fastening the device to the drill string.

3. The device of claim 1 further comprising a first member attached to the portion of the drill spring disposed above the device, and a second member attached to the portion of the drill string disposed below the device, and wherein the second means comprise an intermediate member which is mounted to connect the first and second members and is capable of occupying a first and a second extreme position relative to said first member, in the first extreme position the first and second members being coaxially disposed and engaged with one another and the first member rotates the second member, in the second extreme position the first and second members being disengaged from one another and being off-center relative to one another, the second means further comprising a frangible body holding the first and second members in the first extreme position, the first extreme position corresponding to the first operative position of the device, and the second extreme position corresponding to the second operative position of the device.

4. The device of claim 3 wherein the the first member includes an internal bore having a longitudinal axis which is at an angle to the longitudinal axis of the drill string, and wherein the intermediate member is engaged in the internal bore for longitudinal sliding motion therein.

5. The device of claim 4 wherein the first member includes a multi-faceted boss member, and wherein the second member includes a cavity adapted for interfacing with said multi-faceted boss member to be driven thereby in the first extreme position of the intermediate member, said boss and cavity being disengaged from one another in the second extreme position of the intermediate member.

6. The device of claim 4 wherein the third means comprise a bearing disposed between the intermediate member and the second member.

7. A device adapted to be incorporated into a drill string used in subterranean drilling, for normally functioning as a rigid element capable of transmitting torsional force from a portion of the drill string which is disposed above the device to the portion of the drill string which is disposed below the device, and for facilitating release of the lower portion of the drill string when said lower portion is stuck, the device comprising:

a first member having first means for fixedly attaching the first member to a lower end of the upper portion of the drill string;

a second member having second means for fixedly attaching the second member to an upper end of the lower portion of the drill string;

an intermediate member mounted to the first and second members, the intermediate member comprising third means for positioning the first and second members in two distinct positions relative to one another;

fourth means operatively associated with the first member, and the second member for connecting the first member to the second member in the first position so as to impart rotation of the first member to the second member in said first position and for permitting free rotation of the first member relative to the second member in the second position, the first and second members being axially aligned with one another in the first position and being axially off-center relative to one another in the second position, and fifth means operatively associated with the first and second members for maintaining the first and second members in the first position, for releasing the first, and second members from the first position and for permitting the first, and second members to occupy the second position when a greater than a predetermined substantially axial force is applied on the device.

8. The device of claim 7 wherein the fifth means comprise a body having a weak portion which breaks when the greater than predetermined axial force is applied.

9. The device of claim 8 wherein the first member includes an internal bore into which the intermediate member is mounted, the internal bore and the intermediate member jointly comprising spiral splines and matching spline receiving slots disposed offset relative to the longitudinal axis of the device, said splines and spline receiving slots comprising the third means.

10. The device of claim 9 wherein the splines are disposed in the intermediate member and the spline receiving slots are incorporated in the internal bore.

11. The device of claim 7 wherein the first member includes an internal bore having its longitudinal axis at an angle relative to the longitudinal axis of the device, and wherein the third means of the intermediate member includes a surface adapted for interfacing wtih the internal bore and for sliding in a longitudinal direction in said internal bore.

12. The device of claim 11 wherein the fourth means include a multi-faceted boss disposed on the first member, and an opening in the second member adapted for receiving and interfacing with the multi-faceted boss in the first relative position of the first and second members, in said first position rotation of the multi-faceted boss rotating the second member, the multi-faceted boss being disengaged from the opening in the second relative position of the first and second members.

13. The device of claim 12 wherein the internal bore and the surface of the intermediate member adapted for sliding in the internal bore are configured to capture the intermediate member for rotation together with the first member.

14. The device of claim 13 further comprising bearing means operatively disposed between the intermediate member and the second member for permitting free rotation of the intermediate member relative to the second member in the second relative position of the first and second members.

15. A device adapted to be incorporated substantially immediately above the bottom hole assembly of a drill string used in subterranean drilling, for normally functioning as a substantially rigid element capable of transmitting torque from a drill pipe containing upper portion of the drill string which is disposed above the device, to the drill collars containing lower portion of the drill string disposed below the device, and for facilitating release of the lower portion of the drill string when said lower portion is stuck, the device comprising:

a first member having first thread means for fixedly attaching the first member to a drill pipe disposed at a lower end of the upper portion of the drill string, the first member being in substantially coaxial alignment with the drill pipe and having an interior bore which has its longitudinal axis at an angle relative to the longitudinal axis of the drill pipe;

a second member having second thread means for fixedly attaching the second member to a drill collar disposed at an upper end of the lower portion of the drill string, the second member being in substantially coaxial alignment with the drill collar and having an interior bore which has its longitudinal axis in substantially coaxial alignment with the drill collar;

third means jointly incorporated in the first and second members for connecting the first member with the second member and for transmitting rotary movement of the first member to the second member;

an intermediate member mounted into the respective interior bores of the first and second members, the intermediate member and the interior bore of the first member being configured for permitting sliding motion of the intermediate member in the interior bore of the first member between a first and a second extreme position, in the first position the first and second members being disposed substantially coaxially and being connected to one another by the third means for transmission of rotary motion, in the second position of the intermediate member the first and second members being disposed off-center relative to one another and not being connected for transmission of rotary motion by the third means;

fourth means operatively associated with the first member, second member and intermediate member for maintaining the intermediate member in the first position in the interior bore of the first member and for permitting the intermediate member to slide into the second position when a greater than a predetermined pulling force is applied in an axial direction between the upper and lower portions of the drill string, and bearing means mounted into the second member for permitting rotation of the intermediate member relative to the second member in the second position of the intermediate member.

16. The device of claim 15 wherein the third means comprise at least one boss protruding from one of the first and second members, and a cavity disposed in the other one of said first and second members to receive the boss in the first position of the intermediate member relative to the first member.

17. The device of claim 16 wherein the boss is a multifaceted body protruding from the first member.

18. The device of claim 17 wherein the boss is a substantially hexagonal body.

19. The device of claim 16 wherein the interior bore of the first member and the intermediate member are jointly configured for engagement of the intermediate member in the interior bore of the first member for rotation of the intermediate member together with the first member.

20. The device of claim 19 wherein the interior bore of the first member is a hexagonal bore.

21. The device of claim 16 wherein the fourth means comprise a frangible member mounted to the first member and having a weak portion adapted to break when the greater than the predetermined pulling force is applied.

22. The device of claim 16 wherein the fourth means comprise spring means for connecting the first member with the intermediate member, said spring means adapted for being overcome by the greater than predetermined pulling force.

* * * * *